US005134982A

United States Patent [19]

Hosoi

[11] Patent Number: 5,134,982

[45] Date of Patent: Aug. 4, 1992

[54] DISTINCTION DEVICE OF FUEL IN USE FOR INTERNAL COMBUSTION ENGINE

[75] Inventor: Keiji Hosoi, Shizuoka, Japan

[73] Assignee: Suzuki Motor Corporation, Shizuoka, Japan

[21] Appl. No.: 710,579

[22] Filed: Jun. 5, 1991

[30] Foreign Application Priority Data

Jun. 28, 1990 [JP] Japan ..... 2-168504

[51] Int. Cl.[5] ..... F02D 41/10

[52] U.S. Cl. ..... 123/682

[58] Field of Search ..... 123/492, 493

[56] References Cited

U.S. PATENT DOCUMENTS 4,616,619 10/1986 Saito et al. ..... 123/492 X
4,627,404 12/1986 Saito et al. ..... 123/492
4,633,840 1/1987 Saito et al. ..... 123/492 X
4,635,200 1/1987 Egami et al. ..... 123/492 X
4,667,631 5/1987 Kinugasa ..... 123/492 X
4,936,278 6/1990 Umeda ..... 123/492 X

FOREIGN PATENT DOCUMENTS 63-162951 7/1988 Japan .

*Primary Examiner*—Tony M. Argenbright
*Attorney, Agent, or Firm*—Flynn, Thiel, Boutell & Tanis

[57] ABSTRACT

An internal combustion engine includes a feedback control system for effecting feedback control in order to enrich the air-fuel ratio during acceleration. A distinction device is provided for distinguishing the fuel in use by the internal combustion engine, and includes a control arrangement which distinguishes that the fuel in use is heavy gravity fuel when feedback signals sequentially produced by the feedback control system indicate that the air-fuel ratio has remained lean for at least a predetermined time after acceleration has been attempted.

4 Claims, 3 Drawing Sheets $O_2$ SENSOR SIGNAL DURING ACCELERATION (USUAL TIME)

$O_2$ SENSOR SIGNAL WHEN HEAVY GRAVITY FUEL IS USED

DISTINCTION DEVICE OF FUEL IN USE FOR INTERNAL COMBUSTION ENGINE

FIELD OF THE INVENTION

This invention relates to a distinction device for distinguishing fuel in the use by an internal combustion engine, and particularly to a distinction device which effects feedback control in order to enrich the air-fuel ratio during acceleration by increasing the amount of fuel supplied, that is, by acceleration increase when the internal combustion engine is accelerated.

BACKGROUND OF THE INVENTION

An EFI (Electric Fuel Injection) system having a feedback control function and using an $O_2$ sensor as an exhaust sensor inputs an $O_2$ concentration detection signal from the $O_2$ sensor into a control means which feedback controls the air-fuel ratio to a predetermined value in accordance with the $O_2$ concentration.

One conventional example has a single point fuel injection valve, and effects feedback control by an $O_2$ sensor at a steady run when in a normal acceleration as shown in FIG. 3. When the air-fuel ratio (A/F) becomes 14.7 and it is brought into an acceleration state during running, acceleration increase is preformed for a certain time. Since it enters into a power area, the air-fuel ratio becomes 13 or less (see FIG. 3(*c*)).

At this time, the $O_2$ sensor continuously outputs rich signals at a certain delay from the moment it is shifted to acceleration (see FIG. 3(*a*)).

However, if an attempt for acceleration is made using fuel low in distillation, i.e. heavy gravity fuel, in the same manner as mentioned above, delay occurs when air-fuel mixture is fed into the combustion chamber owing to inferior volatility of the heavy gravity fuel after the accelerator is opened. This becomes a factor for causing waver, stumble, etc. owing to leaning of the air-fuel ratio. Finally, it sometimes results in stalling of the engine.

This phenomenon significantly appears especially when in cold operation and occurs more easily as the distance from the fuel injection valve to the combustion chamber becomes longer when the fuel injection valve is disposed further upstream from the throttle valve.

As shown in FIGS. 3(*b*) and 4(*b*), the aforementioned problems can arise, for example, during an attempt to accelerate from a given steady running condition to another, higher speed steady running condition.

Fuel used in the United States of America is, in general, very wide in range such as 80°~120° C. at the 50% distillation point. For example, if a usual normal setting is effected when fuel of either of the two extremes is used, drivability is extremely deteriorated.

That is, in the conventional general system, correction is not made at all when heavy gravity, low volatility fuel is used, and the values of post-start increase, acceleration increase, etc., when in cold operation must be set large anticipating the use of heavy gravity fuel.

A distinction device of fuel being used by an internal combustion engine is disclosed in Japanese Patent Early Laid-Open Publication No. sho 63-162951. According to a method disclosed in this publication for controlling the ignition timing and air-fuel ratio of an internal combustion engine, the ignition timing is spark controlled when the octane number of fuel in use is high and the air-fuel ratio is feedback controlled to a target air-fuel ratio in accordance with the output of the $O_2$ sensor.

The air-fuel ratio is controlled to be more rich than the target air-fuel ratio when the octane number of fuel in use is high, and $NO_x$ is reduced to obtain a favorable exhaust emission without lowering engine output when fuel of a high octane number is used.

The conventional device does not have a correction function for distinguishing the properties of fuel and effecting control which is fitted to the properties of heavy gravity fuel. It does not have a function for learning such distinguished properties of fuel, either. Therefore, if the values of post-start increase, acceleration increase, etc. are preset to be large, anticipating the use of heavy gravity fuel, the air-fuel ratio becomes over-rich when usual fuel of average volatility is used, drivability becomes worse, a large amount of hazardous exhaust gas is discharged as the drivability becomes worse, and the function of cleaning exhaust gas is also impaired.

On the contrary, if the values of post-start increase, acceleration increase, etc. are set without anticipating the use of heavy gravity fuel, engine stall and significant deterioration of drivability arise after the start of the engine when heavy gravity fuel is used. This is disadvantageous in view of practical use.

In order to reduce the above-mentioned inconveniences, it is an object of the present invention to provide a distinction device which distinguishes fuel in use by an internal combustion engine, comprising control means for distinguishing fuel in use as heavy gravity fuel when lean signals of air-fuel ratio are sequentially output for a predetermined time or more at the start of increased fuel supply during acceleration of an internal combustion engine, and for learning properties of the fuel in order to control the air-fuel ratio depending on the fuel, thereby enabling the air-fuel ratio to be set as necessary for heavy gravity fuel when said control means has distinguished that the fuel in use is heavy gravity fuel. As a result, the occurrence of waver and engine stall during acceleration can be prevented, the acceleration increase is not required to be preset in all cases to a large value anticipating the use of heavy gravity fuel, and drivability can be maintained in an excellent state irrespective of the fuel in use.

The present invention is used in an internal combustion engine for effecting feedback control in order to enrich the air-fuel ratio during acceleration by increasing the supply of fuel when accelerating, and comprises control means for distinguishing fuel in use as heavy gravity fuel when lean signals are sequentially output for a predetermined time or more when the fuel supply is increased during acceleration, and for learning the properties of said fuel in order to control the air-fuel ratio depending on such learned properties.

By virtue of the above-mentioned construction, when lean signals of air-fuel ratio are sequentially output for a predetermined time or more at the start of increased fuel supply during acceleration of the internal combustion engine, the fuel in use is distinguished as heavy gravity fuel by control means, properties of the fuel are learned in order to control the air-fuel ratio depending on the learned properties, the air-fuel ratio is set corresponding to the heavy gravity fuel, occurrence of waver and engine stall during acceleration can be prevented, the amount of acceleration increase is not required to be preset in all cases to a large value anticipating the use of heavy gravity fuel, and drivability is maintained in an excellent state irrespective of the fuel in use.

BRIEF DESCRIPTION OF THE DRAWINGS

The embodiment of the present invention will be described in detail below with reference to the drawings, in which:

FIG. 3(*b*) is a time chart showing the acceleration increase associated with FIG. 3(*a*);

FIG. 3(*c*) is a time chart showing the air-fuel ratio associated with FIGS. 3(*a*) and 3(*b*);

FIG. 4(*b*) is a time chart showing the attempted acceleration increase associated with FIG. 4(*a*); and FIG. 4(*c*) is a time chart showing the air-fuel ratio associated with FIGS. 4(*a*) and 4(*b*).

DETAILED DESCRIPTION

Figure 1:
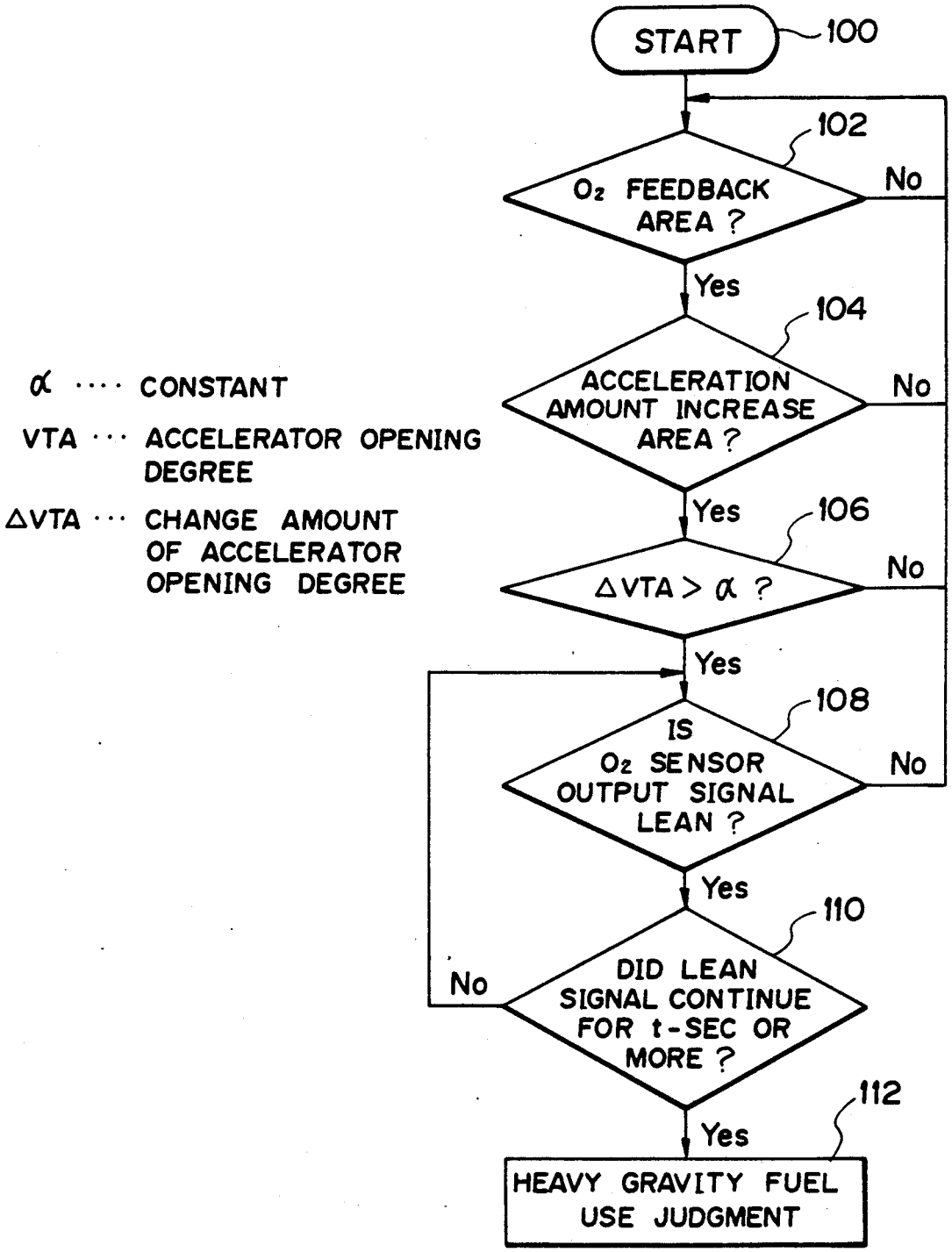
FIG. 1 is a flowchart which illustrates how the present invention distinguishes the fuel being used by an internal combustion engine.
Figure 2:
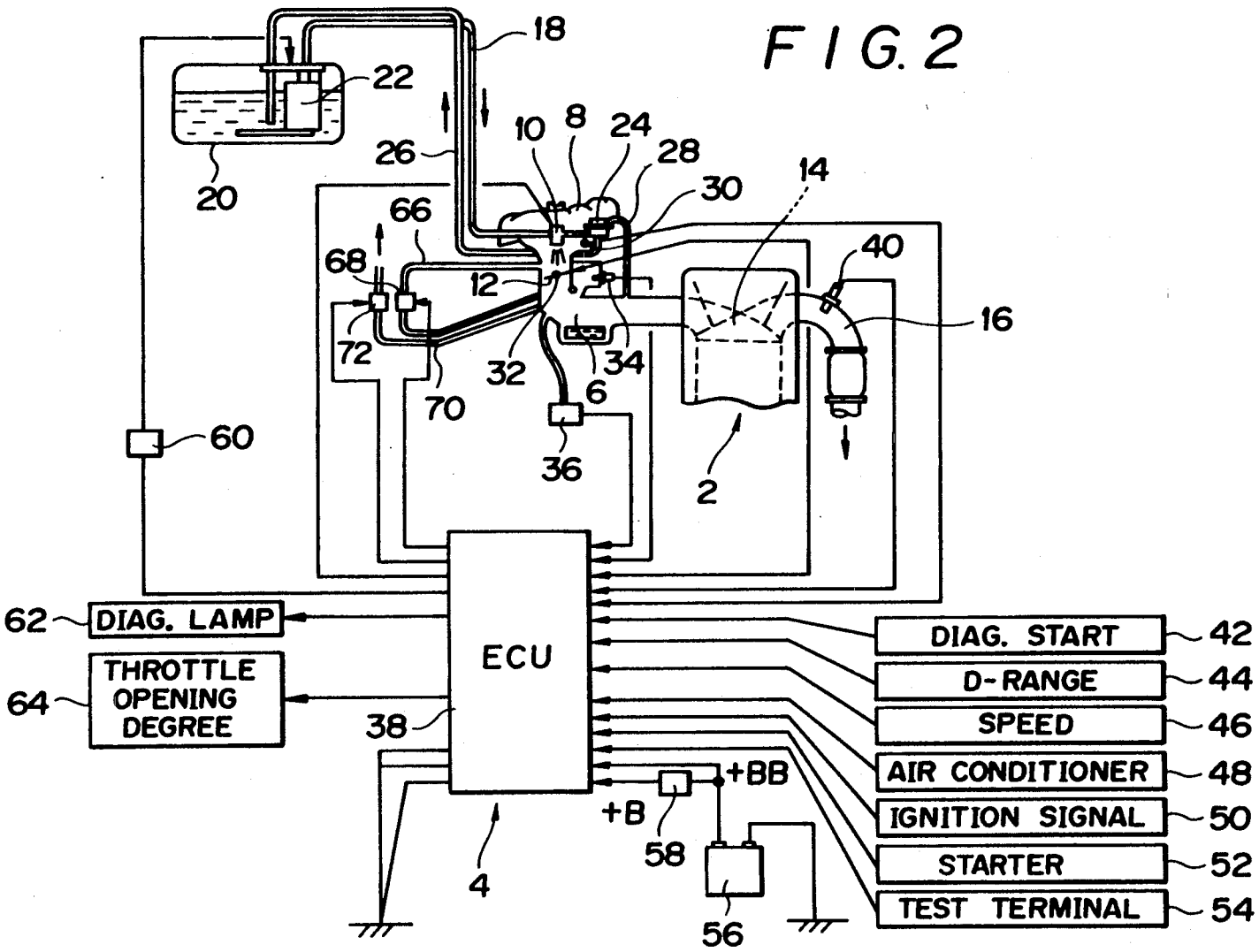
FIG. 2 is a schematic explanatory view of a distinction device according to the invention which executes the control procedure of FIG. 1.
Figure 3A:
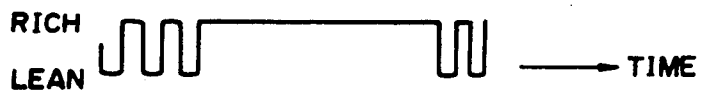
FIG. 3(a) PRIOR ART
FIG. 3(*a*) is a time chart showing conventional operation of an $O_2$ sensor signal during acceleration using fuel of average volatility.
Figure 3B:
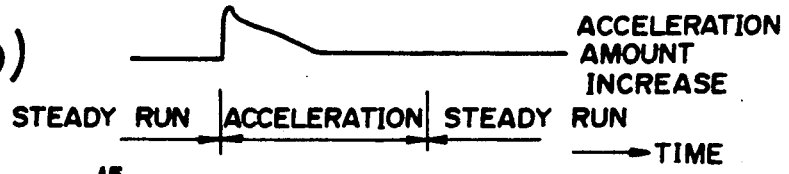
FIG. 3(b) PRIOR ART
Figure 3C:
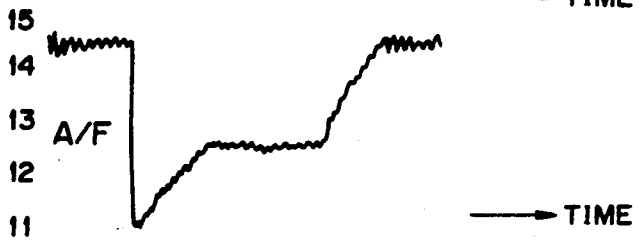
FIG. 3(c) PRIOR ART
Figure 4A:
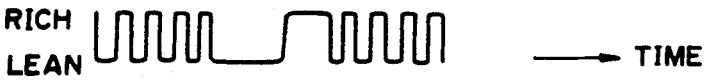
FIG. 4(a) PRIOR ART
FIG. 4(*a*) is a time chart showing conventional operation of an $O_2$ sensor signal during attempted acceleration when heavy gravity fuel is used.
Figure 4B:
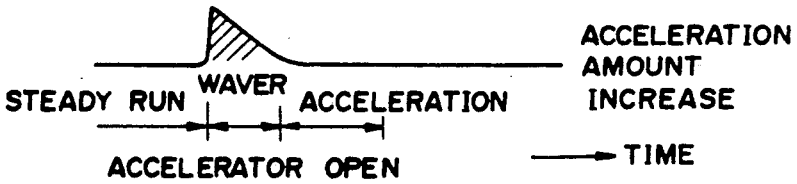
FIG. 4(b) PRIOR ART
Figure 4C:
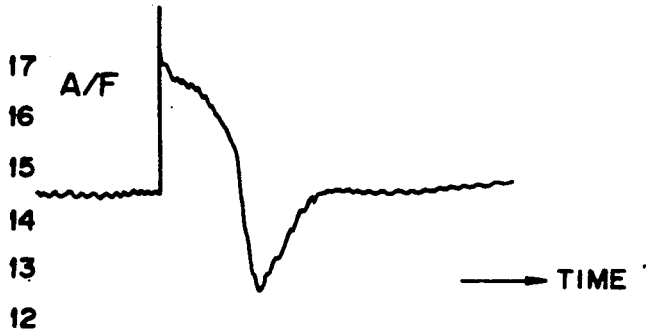
FIG. 4(c) PRIOR ART

FIGS. 1 and 2 show one embodiment of the present invention. In FIG. 2, the numeral 2 denotes an internal combustion engine, and 4 a fuel control unit. This internal combustion engine 2 includes, for example, a single point injection fuel feeder. The internal combustion engine 2 is provided with an air cleaner 8, a single point fuel injection valve 10 constituting a fuel system, and an intake throttle valve 12 arranged in this order in an air-intake passage 6 thereof. Air intaken from the air cleaner 8 is mixed with fuel as jet fed through the fuel injection valve 10, and the mixture is then taken into a combustion chamber 14 for combustion. Exhaust generated as a result of combustion is discharged outside through an exhaust passage 16.

The fuel injection valve 10 is communicated with a fuel tank 20 through a fuel feeding passage 18. Fuel in the fuel tank 20 is fed to the fuel injection valve 10 by a fuel pump 22 through the fuel feeding passage 18. A pressure regulator 24 introduces intake pressure through a pressure introduction passage 28 into the intake passage 6 on the downstream side of the intake throttle valve 12 for regulating fuel pressure. The pressure regulator 24 regulates the fuel pressure to a predetermined pressure and returns surplus fuel to the fuel tank 20 through the fuel return passage 26.

The intake passage 6 is provided with an intake air temperature sensor 30, a throttle opening degree sensor 32 for detecting the opening state of the intake throttle valve 12, a water temperature sensor 34 for detecting the temperature of cooling water, and a pressure sensor 36 for detecting intake air pressure. An $O_2$ sensor 40 is disposed in the exhaust passage 16 for detecting the $O_2$ content of the exhaust gases, and is connected to the input side of a control unit 38 of the fuel control unit 4. Furthermore, a diagnosis start signal portion 42, a D-range signal portion 44 for detecting a D-range (Drive) position of a shift lever (not shown), a speed sensor 46, an air conditioner 48, an ignition signal portion 50, a starter portion 52, a test terminal portion 54, a battery 56, and a main relay 58 are connected to the input side of the control unit 38.

On the other hand, the fuel injection valve 10 is connected to the output side of the control unit 38. Furthermore, the fuel pump 22 is connected to the output side of the control unit 38 through a pump relay 60. Also, further connected to the output side of the control unit 38 are a diagnosis lamp 62, a throttle opening degree portion 64, a bypass air control valve 68 for controlling the amount of bypass air in a bypass passage 66 which intercommunicates the upstream and downstream sides of the intake throttle valve 12 of the intake passage 6, and a pressure regulating valve 72 for regulating the introduction pressure of a pressure introduction passage 70 for controlling a conventional EGR valve (not shown) and for intercommunicating the downstream side of the intake throttle valve with the EGR valve.

Owing to the foregoing arrangement, the control unit 38 (ECU) of the fuel control unit 4, as shown in FIG. 2, receives information regarding the number of engine revolutions, ignition pulse, cooling water temperature, intake air temperature, throttle opening degree, etc. from various sensors 30~36 and instruments 40~58 as input signals. The device of FIG. 2 uses this information to jet feed fuel to the internal combustion engine 2 by actuating the fuel injection valve 10, and to feedback control the air-fuel ratio of air-fuel mixture which is fed to the internal combustion engine. The air-fuel mixture is converged to a target value by inputting a signal from the $O_2$ sensor 40 to control unit 38. This signal from the $O_2$ sensor is used to distinguish heavy gravity fuel where heavy gravity fuel is used. More specifically, when lean signals of the air-fuel ratio are sequentially output for a predetermined time or more when fuel injection is increased during acceleration, the control unit 38 determines that heavy gravity fuel is being used. The control unit 38 also learns the properties of the fuel in order to control the air-fuel ratio depending on such learned properties.

More specifically, the control unit 38 distinguishes the fuel in use as heavy gravity fuel when the $O_2$ sensor 40 sequentially outputs lean signals for a predetermined time, for example t seconds or more, in spite of the fact that the air-fuel ratio should have been enriched after t seconds as a result of acceleration amount increase during acceleration where the accelerator is opened. In other words, the control unit takes into consideration the t second delay from the initial actuation of acceleration to the expected output of the $O_2$ sensor due to the acceleration amount increase.

Also, the control unit 38 learns the properties of the fuel after distinction and controls the air-fuel ratio as an acceleration amount increase which is larger than the acceleration amount increase of existence of an interpreter (or intermediate member) during acceleration after distinction when the fuel is distinguished as, for example, heavy gravity fuel.

That is, once it is determined that heavy gravity fuel is being used, the control unit 38 controls the air-fuel ratio as though average gravity fuel were being used and as though the desired acceleration is larger than it really is. This compensates for the aforementioned adverse effects of heavy gravity fuel.

Next, the fuel distinction operation will be described with reference to the FIG. 2 flowchart.

Upon actuation of the internal combustion engine 2, a program illustrated by the flowchart is started (100). Thereafter, it is judged whether the control area of the internal combustion engine 2 is a feedback area (i.e., $O_2$ feedback area) of the $O_2$ sensor 40 or not (102). If the judgment (102) is NO, the procedure is repeatedly executed until the judgment (102) becomes YES. If the judgment (102) is YES, control proceeds to the judgment (104) as to whether or not the control area is the acceleration amount increase area where fuel is increased during acceleration where the accelerator is opened.

The above-mentioned expression "$O_2$ feedback area" refers to an area where an air-fuel ratio is feedback controlled by the $O_2$ sensor 40 when, for example, an internal combustion engine is brought into a prescribed driving state such as steady run.

Similarly, the expression "acceleration amount increase area" refers to an area where fuel is increased by a predetermined quantity when the accelerator is released and the running state is brought into an accelerated state.

If this judgment (104) is NO, control returns to the judgment (102) as to whether or not it is the $O_2$ feedback area, and if the judgment (104) is YES, a judgment (106) is made as to whether the change $\Delta$ VTA of the opening degree of the accelerator (throttle opening degree) VTA is larger than a predetermined amount $\alpha$ or not. If the judgment (106) is NO, control returns to the judgment (102) as to whether it is the $O_2$ feedback area or not. If the change $\Delta$ VTA in throttle opening degree VTA is greater than the predetermined amount, then the judgment (106) is YES, and control goes to the judgment (108) as to whether an output signal from the $O_2$ sensor 40 is lean or not.

If the judgment (108) is NO, control returns to the judgment (102) as to whether it is the $O_2$ feedback area or not, and if the judgment (108) is YES, a judgment (110) is made as to whether the lean output signals have been sequentially output for t seconds or more from the $O_2$ sensor.

If this judgment (110) is NO, the procedure is repeatedly executed until the lean signals from the $O_2$ sensor 40 discontinue or have been sequentially output for t seconds or more. If the judgment (110) is YES, it is distinguished (112) by the control unit 38 that heavy gravity fuel is in use, whereby the control unit 38 learns the properties of the fuel, i.e., that the fuel in use is heavy gravity fuel, and the air-fuel ratio in the acceleration amount increase is controlled depending on the properties of fuel by the control unit 38 that has learned the properties of fuel.

That is, the control unit 38 learns the properties of the fuel and controls appropriately when it is judged that the fuel is heavy gravity fuel. As for the learning function of the control unit 38, two types can be used. One is that the learning function is reset when the internal combustion engine 2 is stopped, and the other is that the learning function is not reset when the internal combustion engine is stopped. If the learning function is not reset, a new distinction program of usual fuel is prepared, so that memory of the control unit can be rewritten from the heavy gravity fuel to the usual fuel.

Thus, when the engine is topped, the learned fuel properties may selectively be retained or discarded by the control unit 38, as desired. If the learned properties are retained, then they can be used again during subsequent control of acceleration.

It should be apparent from the foregoing description that the control unit 38 may be implemented using a conventional microprocessor circuit.

Because a distinction function of properties of fuel and a learning control function are added to the control unit 38, the construction of the fuel feeding mechanism of the intake system is not required to be changed, and only changing of a program in the control unit 38 is required to implement the invention. As a consequence, the construction is not complicated, manufacture is easy, cost can be maintained low, and the invention is economically advantageous.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an internal combustion engine having a feedback control system for effecting feedback control in order to enrich the air-fuel ratio during acceleration by increasing the fuel component when accelerating, the improvement comprising:

a distinction device for distinguishing fuel in use by said internal combustion engine, including selectively activatable control means for (1) distinguishing the fuel in use as heavy gravity fuel when lean feedback signals are sequentially produced by said feedback control system for a predetermined time or more when the fuel component is increased during acceleration and (2) learning the volatility properties of said fuel in order to control the air-fuel ratio depending on such learned properties, and means for activating said control means at a point in time during acceleration regardless of the engine speed and engine temperature at that point in time.

2. In an internal combustion engine having a throttle valve disposed in an intake passage in which an air-fuel mixture is prepared for combustion, said throttle valve being movable into a plurality of operating positions, and feedback control means for effecting feedback control of the air-fuel mixture, the improvement comprising:

selectively activatable fuel distinguishing means for determining a volatility characteristic of the fuel in the air-fuel mixture, and means for activating said fuel distinguishing means in response to a predetermined amount of change in the operating position of said throttle valve regardless of the engine speed and engine temperature.

3. An internal combustion engine according to claim 2, wherein said feedback control means includes exhaust gas sensor means for detecting information about exhaust gas produced by combustion of the air-fuel mixture, said exhaust gas sensor means including means for producing a feedback signal which indicates whether the air-fuel mixture is rich or lean based on the exhaust gas information, and said fuel distinguishing means including means for determining whether the feedback signal has indicated a lean air-fuel mixture for more than a predetermined time after the operating position of said throttle valve has changed by more than said predetermined amount.

4. An internal combustion engine according to claim 3, wherein said means for determining whether the feedback signal has indicated a lean air-fuel mixture includes means for immediately recognizing, at a point in time when the feedback signal is still indicating a lean air-fuel mixture, that the feedback signal has already indicated a lean air-fuel mixture for longer than said predetermined time.

* * * * *